US006615823B1

(12) United States Patent
Forand

(10) Patent No.: US 6,615,823 B1
(45) Date of Patent: Sep. 9, 2003

(54) LOG COMBUSTION METHOD AND SUPPORTING DEVICE THEREFOR

(76) Inventor: Jacques Forand, 581, rue Willy, Granby, QBC (CA), J2G 9H9

( * ) Notice: Subject to any disclaimer, the term of this patent is extended or adjusted under 35 U.S.C. 154(b) by 0 days.

(21) Appl. No.: 10/194,264

(22) Filed: Jul. 15, 2002

(51) Int. Cl.[7] ..... F24B 1/193

(52) U.S. Cl. ..... 126/540; 126/152 B; 126/163 R; 126/298

(58) Field of Search ..... 126/298, 540, 126/541, 542, 163 R, 152 A, 152 B, 77, 163 A; 211/60.1; D7/206, 207

(56) References Cited

U.S. PATENT DOCUMENTS

| | | | | |
|---|---|---|---|---|
| 2,031,732 A | | 2/1936 | Plym | |
| 2,185,028 A | | 12/1939 | Hoiland | |
| 2,585,523 A | * | 2/1952 | Wellman | 126/541 |
| 2,985,165 A | | 5/1961 | Peterson et al. | |
| D196,997 S | | 11/1963 | Falkenberg et al. | |
| 3,307,532 A | * | 3/1967 | Hume | 126/298 |
| D215,439 S | | 10/1969 | Hetu | |
| 3,505,986 A | | 4/1970 | Wood | |
| 3,612,034 A | | 10/1971 | Wood et al. | |
| 3,771,511 A | | 11/1973 | Dahlquist | |
| 4,029,078 A | * | 6/1977 | Eller | 126/298 |
| 4,131,108 A | * | 12/1978 | Bauder | 126/298 |
| 4,262,651 A | | 4/1981 | Fajt | |
| D267,223 S | | 12/1982 | Hassett et al. | |
| 4,369,762 A | | 1/1983 | Ziebert | |
| 4,471,757 A | | 9/1984 | Rogers | |
| 6,055,978 A | | 5/2000 | Ellis | |

* cited by examiner

*Primary Examiner*—James C. Yeung

(57) ABSTRACT

A method for combusting a wood log includes positioning the log within a combustion chamber with the log first end positioned above the log second end so that the log longitudinal axis is generally angled relative to and adjacent the chamber base wall and so that the log and the chamber base wall define a generally triangular air volume therebetween. The log is maintained in the angled configuration during at least part of the combustion process. A log supporting structure facilitates use of the method. The structure includes a supporting rod and a spacing base extending from the latter for resting on the base wall of a combustion chamber. The spacing base has a generally flaring configuration and allows gas to flow between the chamber base wall and the supporting rod in a first flow direction generally parallel to the supporting rod, and in a second flow direction generally perpendicular to and away from the rod from the log first end toward the log second end.

17 Claims, 4 Drawing Sheets

LOG COMBUSTION METHOD AND SUPPORTING DEVICE THEREFOR

FIELD OF THE INVENTION

The present invention relates to the general field of solid fuel combustion methods and devices and is more particularly concerned with a wood log combustion method and supporting device therefor.

BACKGROUND OF THE INVENTION

Solid fuel burning stoves such as wood-burning stoves which rely on radiation and convection of the stove itself are well known. In view of the continually increasing cost for running more sophisticated centralized heating systems relying on oil or electricity and in the context of social trends such as so-called "cocooning", such stoves are becoming more in vogue. They are increasingly being used to heat various rooms in houses in lieu of or supplemental to other heating methods.

Generally, such stoves include a combustion chamber into which air is directed, burned and exited through a flue outlet generally positioned centrally at the top of the combustion chamber. The stoves are typically made of metal and bricks and burn solid combustible material such as wood, coal or the like in order to raise the temperature of the metal and bricks sufficiently to radiate and convect heat throughout the room where the stove is employed.

Typically, a door is provided on the front of the stove allowing access for adding fuel and removing ashes or other debris once the fuel has been burned. In addition, the door usually has apertures extending therethrough for enhancing radiation from the stove and for creating a draft. The draft provides air containing oxygen to ignite the fuel and maintain combustion within the stove.

It has long been recognized that wood, particularly well seasoned, dry hardwood contains a very substantial potential of thermal energy that can be released by burning. Among the various problems that have been encountered in the use of wood in stoves and furnaces as a thermal energy source is the fact that the wood tends to burn rapidly with the consequent release of more thermal energy than that which can be effectively heat-exchanged into a distribution medium such as air. Accordingly, a substantial portion of the potential energy of the fuel is lost through the exhaust stack, flue or chimney.

Various techniques have been used in attempts to overcome or at least reduce problems associated with poor heating efficiency related to loss of heat through the exhaust stack or flue. One such technique which has been utilized is that of using so-called "starved air" combustion. This technique involves the restriction of the amount of air and thus oxygen available in the combustion chamber so as to slow the rate at which the wood burns. Various designs of stoves commonly referred to as slow combustion stoves have been designed to achieve "starved air" combustion.

Although these "starved air" combustion techniques have produced some degree of success, they nevertheless have also created additional problems. Indeed, the use of so-called "starved air" combustion results in incomplete combustion of many of the volatile hydrocarbon constituents of the wood. Collectively, these constituents when they become deposited are referred to as creosote. Hence, creosote is a complex of aromatic hydrocarbons including tar acids, tar bases and phenols.

Many of these constituents become deposited on the surfaces through which the flue gasses pass if the flue gas temperature drops below a given temperature. These deposits, in turn, build up and tend to clog and thus interfere with the movement of gasses through the flue. Also, being flammable, creosote has a tendency to catch fire resulting in so-called chimney fires bringing with it potential serious material as well as human consequences.

Furthermore, the use of slow combustion stoves results in a lower heating efficiency inasmuch as all the solid fuel available is not burned within the combustion chamber. Also, it is well know that too little air, preventing complete fuel combustion, leaves a lot of ashes in the stove. Furthermore, incomplete combustion also produces carbon monoxide which is a toxic gas.

On the other hand, it is also well known in the furnace or fireplace art that too much air causes rapid combustion and a great loss of heat through the fireplace or stove pipe/chimney. Potentially recoverable energy is lost and the combustible material soon is exhausted. Temperature spikes, wherein the temperature rises to relatively high levels in a relatively short lapse of time are sometimes created leading to discomfort and to potential damage to the heating components.

Hence, the lack of control over the rate of combustion of the combustible material in both open and restricted air environments leads to various serious drawbacks such as loss of energy, poor heating efficiency, wastage of fuel with ecological repercussions, discomfort and potential danger for both material goods and human life. Accordingly, it would prove to be highly desirable to provide both a method and a device for facilitating the control of the rate of combustion of combustible material.

When solid combustible materials such as wood logs, coal or the like are burned or combusted in a open air environment such as a fireplace or in a "starved air" environment such as a slow combustion stove, the solid combustible material is often supported in an elevated or spaced relationship relative to the base wall of the fireplace or stove. Known supporting arrangements for wood logs include log holding throughs, andirons, log retaining grates and the like.

These supporting arrangements are commonly used to elevate the wood logs in order to allow needed oxygen to circulate around the logs, particularly underneath and around their sides and backs so as to facilitate the combustion. Conventional supporting arrangements are also typically provided with spaces or apertures formed therein for allowing ashes to fall through and be separated from the unburned wood. Some supporting arrangements also allow the fireplace or stove to be cleaned. and facilitate the removal of the ashes without having to remove the supporting arrangement itself and/or the logs mounted thereon.

Although conventional log supporting arrangements provide numerous advantages, they nevertheless suffer from at least one major drawback in that they have not been designed to maintain the logs in a predetermined pattern for improving the heating efficiency and obliviating or reducing the herein above-mentioned drawbacks associated with both "open air" and "starved air" environments. Accordingly, there exists a need for an improved log burning method and associated log holding structure therefore.

SUMMARY OF THE INVENTION

It is therefore an object of the present invention to provide an improved log supporting device for an improved log combustion method.

Advantages of the present invention include the proposed method and structure allowing for efficient regulation of the rate of combustion of combustible material in a combustion chamber. Also, the present invention provides enhanced combustion and heat transfer efficiency.

Furthermore, the proposed invention allows for the heat output of the combustion chamber to be maintained substantially constant, in particular preventing over-temperature conditions within the combustion chamber.

Still further, the proposed invention may potentially allow for the reduction in the amount of creosote, carbon monoxide and other potentially harmful combustion by-products. Also, the proposed invention potentially allows for safer, more economical and ecological usage of solid combustible material.

Still furthermore, the proposed supporting structure is designed so as to be manufacturable using conventional forms of manufacture and conventional material so as to provide a log supporting structure that will be economically feasible, long-lasting and relatively trouble-free in operation.

According to an aspect of the present invention, there is provided a log supporting structure for supporting a log positioned within a combustion chamber, the log having a generally elongated configuration defining a log longitudinal axis, a log circumferential surface, a log first end and an opposed log second end, the combustion chamber defining a chamber base wall and having a gas contained therein; the log supporting structure comprises:

a generally elongated supporting rod defining a rod longitudinal axis, a rod circumferential surface, a rod first end and an opposed rod second end, the supporting rod for supporting the log first end at a predetermined location therealong so that the log longitudinal axis extends in a generally perpendicular relationship relative to the rod lonqitudinal axis and in an angled relationship relative to and adjacent the chamber base wall with the log first end positioned above the log second end;

a spacing base extending from the supporting rod for resting on the chamber base wall and maintaining the supporting rod in a predetermined spaced relationship relative to the chamber base wall;

the spacing base having a generally flaring configuration in a geometrical plane generally perpendicular to the rod longitudinal axis and in a direction leading away from the supporting rod;

the spacing base being provided with a longitudinal venting means for allowing the gas to flow between the chamber base wall and the supporting rod in a first flow direction generally parallel to the supporting rod at least partially along the supporting rod;

the spacing base being provided with a transversal venting means for allowing the gas flowing in the first flow direction to flow in a second flow direction generally perpendicular to and away from the supporting rod at the [a] predetermined location along the supporting rod and generally parallel to the chamber base wall from the log first end toward the log second end.

Typically, the longitudinal venting means allows the gas to flow in the first flow direction from a position located adjacent the rod first end to a position located intermediate the rod first and second ends, preferably to a position located adjacent the rod second end.

Preferably, the spacing base includes at least two spacing legs, each of the spacing legs having a generally flaring configuration in a geometrical plane generally perpendicular to the rod longitudinal axis and in a direction leading away from the supporting rod; the longitudinal venting means including a venting aperture formed in at least one of the spacing legs, the transversal venting means including the legs being spaced from each other along the supporting rod so as to define a leg spacing therebetween.

Preferably, at least one of the spacing legs has a generally triangular configuration defining a leg apex and a leg base, the leg apex being attached to the supporting rod.

Preferably, the venting aperture has a generally triangular configuration defining a generally triangular aperture frame, the aperture frame including a frame bridging segment extending across the leg base and a pair of frame spacing segments tapering towards each other in a direction leading from opposed ends of the frame bridging segment towards the leg apex.

Typically, at least one of the spacing legs is provided with at least one resting prong extending therefrom, the resting prong defining a prong abutment surface for abuttingly contacting the chamber base wall when the log supporting structure is resting on the chamber base wall, the resting prong defining a base wall-to-leg clearance between the chamber base wall and the spacing leg when the prong abutment surface abuttingly contacts the chamber base wall.

Typically, at least one of the spacing legs is provided with a pair of spaced apart resting prongs extending therefrom, each of the resting prongs defining a prong abutment surface for abuttingly contacting the chamber base wall when the log supporting structure is resting on the chamber base wall, the resting prongs defining a base wall-to-leg clearance between the chamber base wall and the spacing leg when the prong abutment surfaces abuttingly contacts the chamber base wall.

Preferably, the rod circumferential surface defines a generally arcuate rod-to-log contacting section. The latter extends over an angular range at least equal to 180 degrees.

Preferably, the supporting rod has a generally disc-shaped cross-sectional configuration and the leg apex defines a generally arcuate rod receiving recess for receiving a rod-to-leg contacting section of the rod circumferential surface, wherein the remainder of the rod circumferential surface defines a rod-to-log contacting section having a generally arcuate configuration.

Preferably, the supporting rod and the spacing leg are both made out of a metallic alloy, the rod-to-leg contacting section being attached to the rod receiving recess by welding.

Preferably, the spacing leg is made out of a generally flat piece of material.

According to another aspect of the present invention, there is provided in combination, a combustion chamber and a log supporting structure for supporting a log positioned within the combustion chamber, the log having a generally elongated configuration defining a log longitudinal axis, a log circumferential surface, a log first end and an opposed log second end, the combustion chamber defining a chamber base wall and a chamber peripheral wall, the combustion chamber having a gas contained therein; the log supporting structure comprises:

a log supporting means attached to the combustion chamber for supporting the log so that the log longitudinal axis extends in an angled relationship relative to the chamber base wall with the log first end positioned above the log second end; and an attachment means for attaching the log supporting means to the combustion chamber.

Preferably, the log supporting means is positioned, configured and sized so as to support the log in a generally proximal relationship relative to the chamber base wall, the log supporting means supporting the log generally adjacent the log first end while allowing the log second end to be supported by the chamber base wall; whereby when the log is supported by the log supporting means and the chamber base wall respectively adjacent the log first and second ends, the log and the chamber base wall form a generally triangular air volume therebetween.

Typically, the attachment means allows for adjustment of the angular relationship between the log longitudinal axis and the chamber base wall and The attachment means allows for adjustment of the spacing between the log and the chamber peripheral wall.

Preferably, the log supporting means includes:

a supporting rod for supporting the log so that the log longitudinal axis extends in an angled relationship relative to the chamber base wall with the log first end positioned above the log second end, the supporting rod defining a rod longitudinal axis; and a supporting bracket attached to the chamber peripheral wall and supporting the supporting rod perpendicularly to the rod axis in a predetermined spaced relationship relative to the chamber base wall.

Preferably, the supporting bracket is of a generally L-shaped configuration and defines a bracket attachment leg and a generally perpendicularly extending bracket supporting leg, the latter supporting the supporting rod in a predetermined lateral spaced relationship relative to the chamber peripheral wall; and wherein the attachment means includes:

a chamber attachment aperture formed in the chamber peripheral wall;

a bracket attachment aperture extending through the bracket attachment leg; and an attachment component for extending through both the chamber attachment aperture and the bracket attachment aperture.

Preferably, the bracket supporting leg is provided with retaining notches formed therealong for restricting lateral movement of the supporting rod along the bracket supporting leg and for allowing adjustment of the predetermined lateral spaced relationship between the supporting rod and the chamber peripheral wall;

the bracket attachment leg being provided with a set of spaced apart chamber attachment apertures for allowing adjustment of the predetermined spaced relationship between the supporting rod and the chamber base wall.

According to a further aspect of the present invention, there is provided a method for combusting a wood log inside a combustion chamber, the combustion chamber having an air inlet, an air outlet; the wood log having a generally elongated configuration defining a log longitudinal axis, a log first end, a log second end, a log length, a log diameter and a log circumferential surface, the method comprises the steps of:

positioning the log within the combustion chamber generally adjacent the chamber base wall in a combustion configuration wherein the log first end is at a first spacing distance relative to the chamber base wall and wherein the log second end is at a second spacing distance relative to the chamber base wall, the first spacing distance being greater than the second spacing distance so that the log longitudinal axis is generally angled relative to and adjacent the chamber base wall and so that the log and the chamber base wall define a generally triangular air volume therebetween;

ensuring that the air volume between the log and said chamber base wall allows circulation of air generally thereacross in both a first direction generally perpendicular to the log longitudinal axis adjacent the log first end and a second direction generally parallel to the chamber base wall from the log first end toward the log second end;

igniting the log; and maintaining the log in the combustion configuration during at least part of the combustion of the log.

Preferably, the step of positioning the log within the combustion chamber generally adjacent the chamber base wall ensures that the rod longitudinal axis is angled from the chamber base wall by an angle of about fifteen (15) degrees.

Preferably, the method further comprises the step of adjusting the angular relationship between the rod longitudinal axis and the chamber base wall so as to modulate the combustion speed.

Preferably, the angular relationship between the rod longitudinal axis and the chamber base wall is further adjusted so as to maintain a flame burning substantially along and across the log.

Other objects and advantages of the present invention will become apparent from a careful reading of the detailed description provided herein, within appropriate reference to the accompanying drawings.

BRIEF DESCRIPTION OF THE DRAWINGS

The embodiment of the present invention will now be disclosed, by way of example, and reference to the following drawings in which.

DETAILED DESCRIPTION OF THE PREFERRED EMBODIMENTS

With reference to the annexed drawings the preferred embodiments of the present invention will be herein described for indicative purpose and by no means as of limitation.

Figure 1:
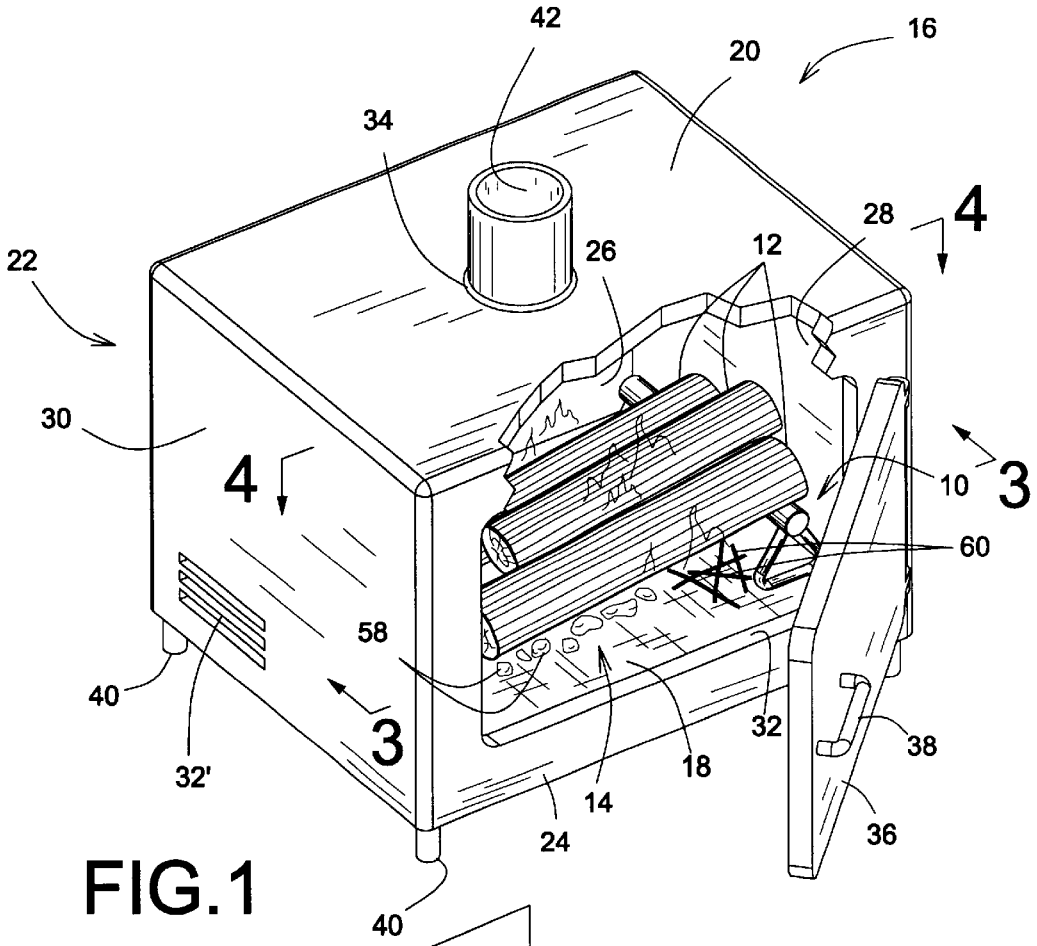
FIG. 1, in a perspective view, illustrates a wood stove having a log supporting structure in accordance with an embodiment of the present invention mounted therein, the log supporting structure being shown supporting wood logs in a combustion configuration associated with a combustion method also in accordance with the present invention.

Referring to FIG. 1, there is shown a log supporting structure 10 in accordance with an embodiment of the present invention being used for supporting a set of logs 12 within a combustion chamber 14. The combustion chamber 14 is shown as being part of a furnace or stove 16. The stove 16 typically includes a chamber base wall 18 (preferably with bricks (not shown)), an opposed chamber top wall 20 and a chamber peripheral wall 22 extending there between. In situations wherein the combustion chamber has a generally parallelepiped-shaped configuration, the chamber peripheral wall 22 typically includes a front wall 24, a rear wall 26 and a pair of opposed side walls 28, 30.

The combustion chamber 14 also includes air-inlet apertures 32, 32' and an air outlet aperture 34 for respectively allowing fresh air to enter into the combustion chamber 14 and warm air associated with volatile combustion products to exit the combustion chamber 14. An inlet flow control means is typically provided for controlling the flow of fresh air into the combustion chamber 14.

Typically, the flow control means at the beginning of the combustion may take the form of a door 36 hingedly connected to the chamber front wall 24 for pivotal movement relative thereto so as to allow for variations in the size of the air inlet aperture 32. Subsequently, other inlet apertures 32' are used when the door 36 is closed. Although not shown, these conventional air inlet apertures 32' generally have controllers to control the air flowing therethrough, the location of these inlet apertures 32' are shown for reference purposes only and could be anywhere else around the combustion chamber 14 without departing from the scope of the present invention. Typically, the door 36 is provided with a door handle 38 and the chamber base wall 18 is mounted on chamber spacing legs 40 for spacing the chamber base wall 18 from a floor surface on which the stove 16 is rested. Also, typically, the air outlet aperture 34 is aeraulically coupled to a chimney or flue 42 for carrying the exhaust air outside of the building in which the stove 16 is being used.

It should be understood that although the hereinafter disclosed method and structure are shown throughout the figures and described as being used in the context of a combustion chamber 14 associated with a stove 16 having a specific configuration, the method and structure associated with the present invention could be used in numerous other contexts such as with "open air" combustion chambers of the chimney type or "restricted air" combustion chambers of the slow combustion stove type or any other suitable context both industrial and residential without departing from the scope of the present invention.

Figure 3:
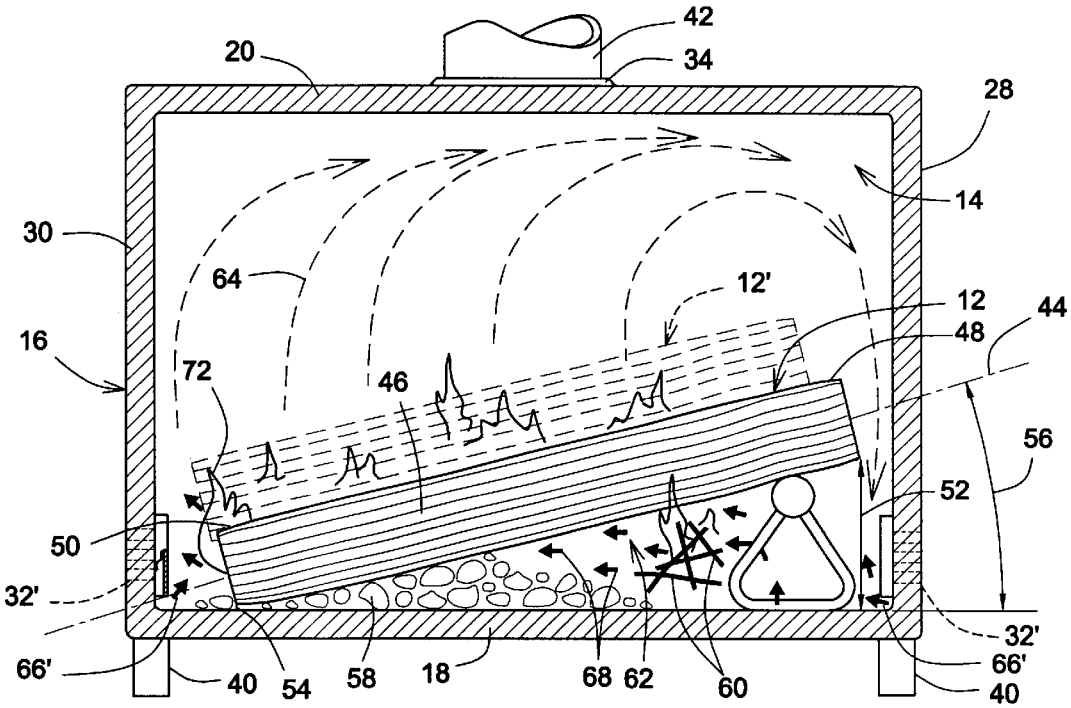
FIG. 3, in a partial vertical cross-sectional view taken along arrows 3—3 of FIG. 1, illustrates the supporting structure in accordance with an embodiment of the present invention being used for supporting logs in a combustion configuration within a combustion chamber.

Referring now more specifically to FIG. 3, there is shown that each log 12 typically has a generally elongated configuration defining a log longitudinal axis 44, a log peripheral or circumferential surface 46, a log first end 48 and an opposed log second end 50. It should be understood that although the logs 12 are illustrated throughout the figures and hereinafter disclosed as being made out of firewood configured as rounded segments of tree trunks or limbs, the logs 12 could be made out of any suitable solid combustible material such as compacted wood chips or the like and could assume any generally elongated configuration including longitudinally split firewood segments without departing from the scope of the present invention. Furthermore, it should be noted that some logs 12', as shown in dotted lines in FIG. 3, could be located on top of others 12 without departing from the scope of the present invention.

Referring now more specifically to FIGS. 1 and 3, there is illustrated a set of wood logs 12 being burned using the method for combusting a wood log in accordance with the present invention. The method includes the step of positioning at least one and typically a set of logs 12 within the combustion chamber 14 generally adjacent to the chamber base wall 18. Each log 12 is positioned in a so-called combustion configuration wherein the log first end 48 is at a first spacing distance 52 relative to the chamber base wall 18 and the log second end 50 is at a second spacing distance 54 relative to the chamber base wall 18. In the situation shown in FIG. 3, the log second spacing distance 54 is virtual since the log second end 50 abuttingly contacts the chamber base wall 18. In other situations (not shown) both the log first and second ends 48, 50 may be spaced relative to the chamber base wall 18.

When the logs 12 are in the combustion configuration, the first spacing distance 52 is greater than the second spacing distance 54 so that the log longitudinal axis 44 is generally angled relative to and adjacent the chamber base wall 18 defining a longitudinal axis-to-base wall angle 56 therebetween of about fifteen (15) degrees, as shown in FIG. 3. Also, when the logs 12 are in the combustion configuration shown in FIGS. 1 and 3, the logs 12 and the chamber basewall 18 define a so-called triangular-like spacing 62 having a generally triangular cross-sectional configuration therebetween. The triangular spacing 62 is typically filled with air about to be combusted and eventually at least partially by ashes 58 or other solid by-products of combustion.

The method also involves igniting at least one of the logs 12 using a suitable ignition method. For example, one of the logs 12 could be ignited using starter materials 60 such as paper or wood including crumbled paper positioned in the triangular spacing 62. It should be understood that other ignition methods could be used without departing from the scope of the present invention.

Once a fire has been ignited, at least one of the logs 12 is typically maintained in the combustion configuration shown in FIGS. 1 and 3 during at least part of the combustion process. By maintaining at least one and preferably all of the logs 12 in the combustion configuration, the flow of combustion air and, hence, the rate of combustion and the location of the flames are at least partially controlled.

Indeed, it is well known that warmer air becomes less dense than colder air and, hence, has a tendency to rise above the colder air. This well-known phenomenon also referred to as gravitational air circulation induces air drafts or circulation within the combustion chamber 14.

Figure 4:
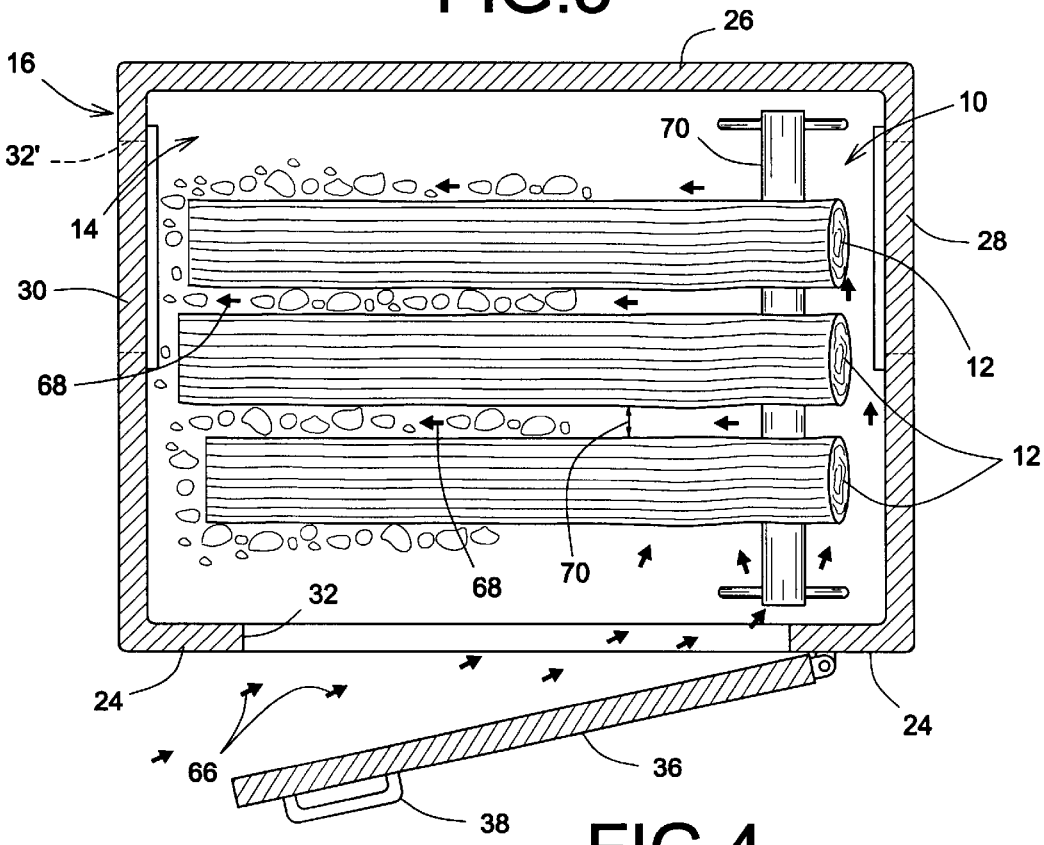
FIG. 4, in a partial horizontal cross-sectional view taken along arrows 4—4 of FIG. 1, illustrates the supporting structure in accordance of an embodiment of the present invention being used for supporting logs in a combustion configuration within a combustion chamber.

As a result of the gravitational air flow or circulation within the combustion chamber 14, the air temperature stratification within the combustion chamber 14 will eventually be such that warmer air will have a tendency to be positioned adjacent to the chamber top wall 20 while colder air, having either cooled within the combustion chamber 14 or having entered the latter through the inlet aperture 32 or 32', will have a tendency to flow towards the triangular spacing 62, as illustrated respectively by arrows 64 and 66 or 66' in FIGS. 3 and 4. The presence of fresh, colder air in the triangular spacing 62 facilitates combustion of the logs 12.

Furthermore, since the triangular spacing 62 has a generally triangular cross-sectional configuration the combustion air within the triangular spacing 62 will have a tendency to flow along the logs 12 from the higher located log first end 48 towards the lower located log second end 50. The gravitational flow of air within the triangular spacing 62 illustrated by arrows 68 in FIG. 3 increases the probability that the logs 12 will be combusted from end to end.

Eventually, most if not all of the air within the combustion chamber 14 will flow according to arrows 68 in the triangular spacing 62 along the logs 12. This flow of air potentially provides improved combustion efficiency. Depending on the lateral spacing 70 between the logs 12 a portion of the flow illustrated by arrow 68 in FIG. 4 will also be in contact with the adjacent lateral surfaces of the logs 12 and with a more or less large area of the log peripheral surfaces 46.

As the logs 12 are consumed by the flames 72, ashes 58 drop on the chamber base wall 18 eventually forming a mass of ashes through which the flow of air 68 may travel. Another step that may be involved in the method associated with the present invention includes insuring that the triangular spacing 62 between the log 12 and the chamber base wall 18 allows circulation of air generally thereacross in both a direction generally parallel and a direction generally perpendicular to the log longitudinal axis 44. Hence, preferably, the log supporting structure 10 is chosen so as to allow circulation of air in both parallel and perpendicular directions relative to the log longitudinal axis 44. Also, typically, compact residues are eventually removed from the triangular spacing 62 so as to allow relatively unobstructed flow of the air 68 in the triangular spacing 62.

The method associated with the present Invention also optionally includes the step of adjusting the angular relationship between the log longitudinal axis 44 and the chamber base wall 18 so as to modulate the combustion speed of the logs 12. Indeed, the combustion speed may be influenced by the configuration of the triangular spacing 62 and, in particular, by the volume of air contained within.

Furthermore, the proposed method may also optionally involve the step of adjusting the value of the angle 56 so as to maintain the flame 72 burning substantially along and across the logs 12. Indeed, in certain situations it may be preferred that the flames 72 substantially extend the full length of the logs 12. This may potentially ensure greater combustion efficiency, less residues and potentially increase contact of the flames 72 with the peripheral walls 22 of the stove 16 so as to increase conductive heat transfer thereto.

Figure 2:
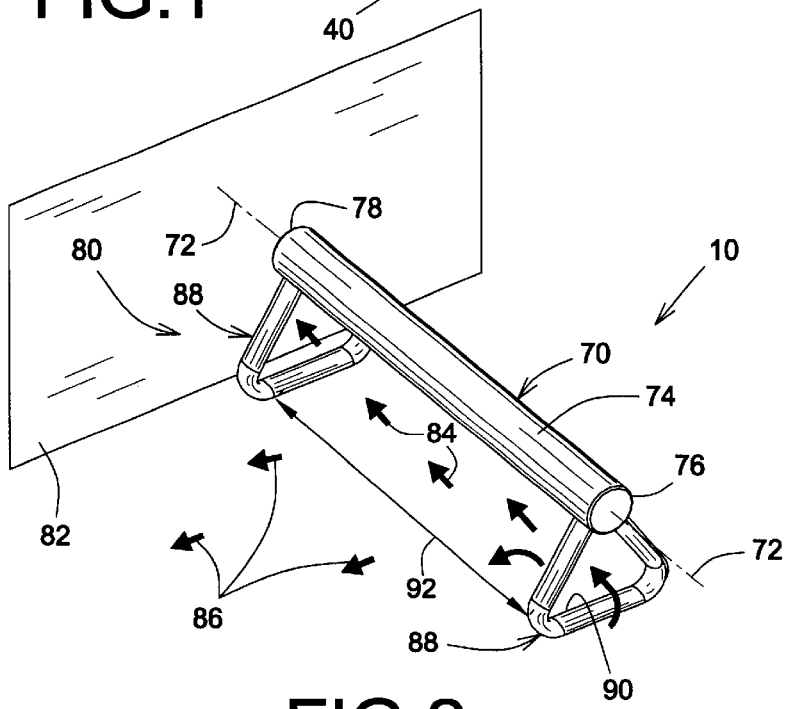
FIG. 2, in a perspective view, illustrates the log supporting structure shown in FIG. 1.

In accordance with the present invention, there is also provided a proposed log supporting structure 10 for supporting the logs 12 in the abovedisclosed combustion configuration. As illustrated more specifically in FIG. 2, the log supporting structure 10 typically includes a generally elongated supporting rod 70 defining a rod longitudinal axis 72, a rod circumferential surface 74, a rod first end 76 and an opposed rod second end 78.

The log supporting structure 10 also includes a spacing base 80 extending from the supporting rod 70 for resting on the chamber base wall 18 and maintaining the supporting rod 70 in a predetermined space relationship relative to the chamber base wall 18. The spacing base 80 typically has a generally flaring configuration in a geometrical plane 82 generally perpendicular to the rod longitudinal axis 72 and in a direction leading away from the supporting rod 70.

The spacing base 80 is provided with a longitudinal venting means for allowing the air or gas within the combustion chamber 14 to flow between the chamber base wall 18 and the supporting rod 70 in a first flow direction 84 generally parallel to the supporting rod 70 and at least partially along the supporting rod 70. The spacing base 80 is also provided with a transversal venting means for allowing the air or gas flowing within the combustion chamber 14 in the first flow direction 84 to also flow in a second flow direction 86 generally perpendicular to and away from the supporting rod 70.

Typically, the longitudinal venting means allows the gas or air to flow in the first flow direction 84 from a position located adjacent the rod first end 76 to a position located intermediate the rod first and second ends 76, 78. Preferably, the longitudinal venting means allows the air or gas to flow in the first flow direction 84 from a position located adjacent the rod first end 76 to a position located adjacent the rod second end 78. The longitudinal venting means hence allows the gas or air to flow in the first flow direction 84 along the length of the supporting rod 70. Also, preferably, the transversal venting means allows the gas or air to flow in the second flow direction 86 at various locations along. the supporting rod 70.

Typically, the spacing base 80 includes at least two spacing legs 88. Each of these spacing legs 88 has a generally flaring configuration in the geometrical plane 82 generally perpendicular to the rod longitudinal axis 72 and in a direction leading away from the supporting rod 70. In such situations, the longitudinal venting means includes a venting aperture 90 formed in at least one and preferably all of the spacing legs 88. In such situations the transversal venting means includes the legs 88 being spaced from each other along the supporting rod 70 so as to define a leg spacing 92 therebetween.

Figure 6:
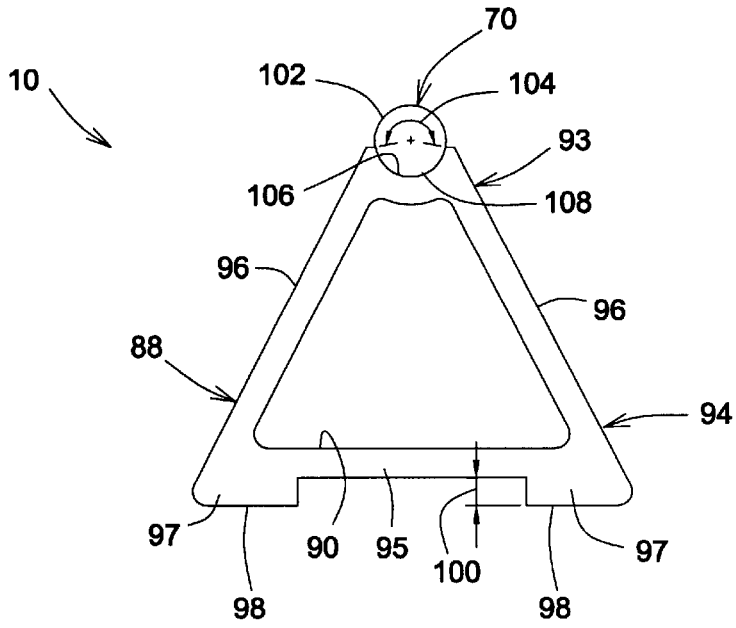
FIG. 6, in a side elevational view, illustrates the log supporting structure shown in FIG. 5.

As illustrated more specifically in FIG. 6, at least one and preferably all of the spacing legs 88 have a generally triangular configuration defining a leg apex 93 and an opposed leg base 94. The leg apex 93 is attached to the supporting rod 70.

Typically, the venting aperture 90 also has a generally triangular configuration defining a generally triangular aperture frame. The aperture frame includes a frame bridging segment 95 extending across the leg base 94 and a pair of frame spacing segments 96 tapering towards each other in a direction leading from opposed ends of the frame bridging segment 95 towards the leg apex 93.

Typically, at least one and preferably all of the spacing legs 88 are provided with at least one resting prong 97 extending therefrom. The resting prong 97 defines a prong abutment surface 98 for abuttingly contacting the chamber base wall 18 when the log supporting structure 10 is resting on the chamber base wall 18. The resting prong 97 defines a base wall-to-leg clearance 100 between the chamber base wall 18 and the spacing leg 88 when the prong abutment surface 98 abuttingly contacts the chamber base wall 18, which is preferred especially when the chamber base wall 18 is uneven.

Figure 5:
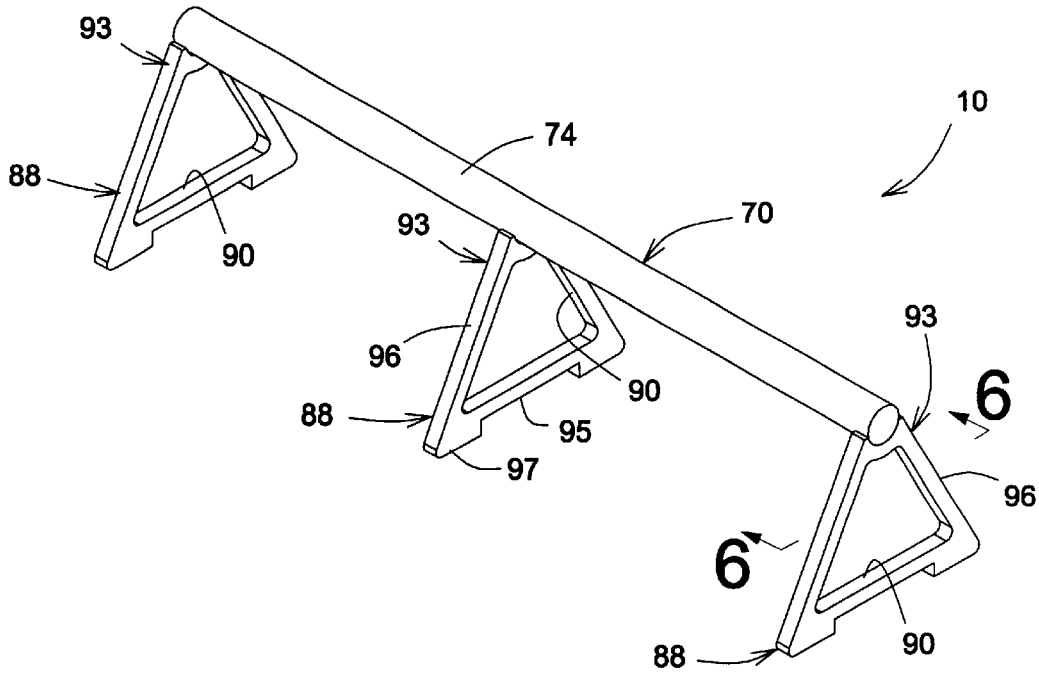
FIG. 5, in a perspective view, illustrates a log supporting structure in accordance with an alternative embodiment of the present invention.

In the embodiment shown in FIGS. 5 and 6, the spacing legs 88 are provided with a pair of resting prongs 97. Each of the resting prongs 97 extends from opposed ends of the bridging segments 95. The resting prongs 97 are provided for stabilizing the legs 88 in situations wherein ash or other debris cover at least part of the chamber base wall 18 thereunderneath. Indeed, by providing an interrupted abutment surface they may be better suited for penetrating through debris and having their abutment surfaces 98 contact the chamber base wall 18. The triangular or more generally flaring configuration of the spacing base 80 is intended to provide an optimized sustentation polygon to the supporting structure 10 while allowing the logs 12 to contact the supporting rod 70 without being obstructed by the spacing base 80 even when the logs 12 are in the angled—combustion configuration.

The rod circumferential surface 74 typically defines a generally arcuate rod-to-log contacting section 102. The rod-to-log contacting section 102 typically extends over an angular range 104 at least equal to one hundred and eighty (180) degrees. The generally arcuate configuration of the rod-to-log contacting section 102 is intended to allow for suitable abutment contact between the sometimes irregular log circumferential surfaces 46 and the rod-to-log contacting section 102 even in situations wherein the logs longitudinal axis 44 extends at an angle relative to the rod longitudinal axis 72.

In the embodiment shown in FIGS. 5 and 6, the supporting rod 70 has a generally disc-shaped cross-sectional configuration and the leg apex 93 defines a generally arcuate rod receiving recess 106 for receiving a rod-to-leg contacting section 108 of the rod circumferential surface 74. The remainder of the rod circumferential surface 74 defines the rod-to-log contacting section 102 having a generally arcuate configuration.

Typically, both the supporting rod 70 and the spacing leg 80 are made out of a metallic alloy allowing the rod-to-leg contacting section 108 to be attached to the rod receiving recess 106 by welding or the like. It should be understood however that the supporting rod 70 and the spacing legs 80 may be made out of any suitable material without departing from the scope of the present invention. Also; typically, the spacing legs 88 are made out of a generally flat piece of material using conventional punch and die or laser cut operations.

Figure 7:
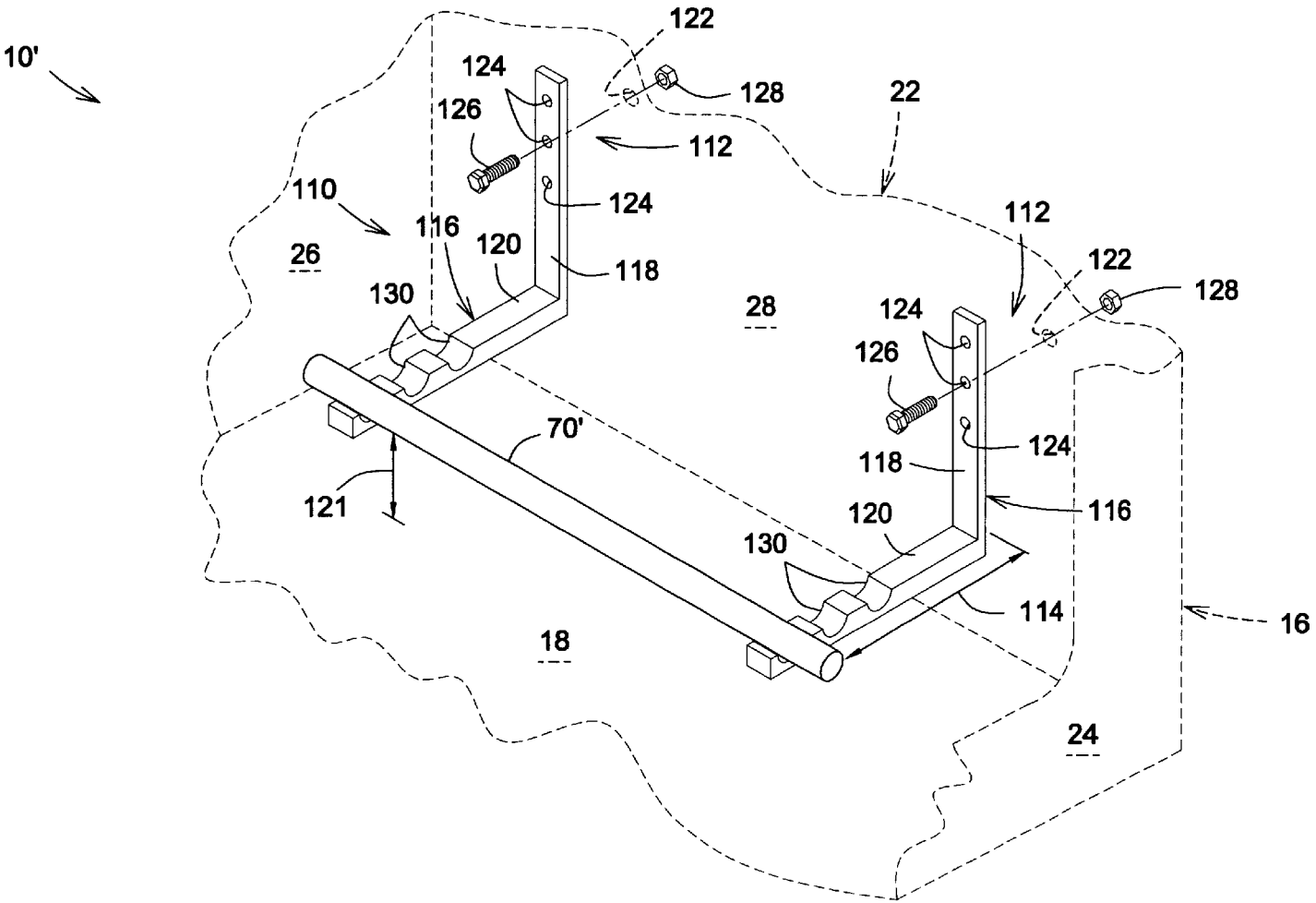
FIG. 7, in a perspective view, illustrates yet an alternative embodiment of a log supporting structure in accordance with an embodiment of the present invention being used for supporting logs in a combustion configuration associated with a method also part of the present invention, the supporting structure and logs being shown for this within a combustion chamber.

The present invention also relates to the combination of a combustion chamber 14 with a log supporting structure 10'. As illustrated more specifically in FIG. 7, in such situations, the log supporting structure 10' includes a log supporting means 110 attached to the combustion chamber 14 (shown in phantom lines for clarity purpose) for supporting the log 12 (not shown in FIG. 7) so that the log longitudinal axis 44 extends in an angled relationship relative to the chamber base wall 18 with the log first end 48 positioned above the log second end 50. The log supporting structure 10' also includes an attachment means 112 for attaching the log supporting means 110 to the combustion chamber 14.

Typically, the log supporting means 110 is positioned, configured and sized so as to support the logs 12 in a generally proximal relationship relative to the chamber base wall 18. The log supporting means 110 supports the logs 12 generally adjacent the log first end 48 while allowing the log second end 50 to be supported by the chamber base wall 18. Alternatively, (in an embodiment not shown) both the log first and second ends 48 and 50 may be supported above the chamber base wall 18.

The log supporting means 110 optionally allows for the adjustment of the angular relationship between the log longitudinal axis 44 and the chamber base wall 18. Also, optionally, the log supporting means 110 allows for adjustment of the lateral spaced relationship or spacing 114 between the log 12 and the chamber peripheral wall 22. Typically, the log supporting means 110 allows for both adjustment of the angular relationship between the log longitudinal axis 44 and the chamber base wall 18 and for adjustment of the spacing 114.

In one embodiment of the invention, the log supporting means 110 includes a pair of generally L-shaped supporting brackets 116 attached to the chamber peripheral wall 22. Each supporting bracket 116 defines a bracket attachment leg 118 and a generally perpendicularly extending bracket supporting leg 120. The latter supports, preferably releasably, the supporting rod 70' in a spaced relationship relative to the chamber base wall 18, as represented by height 121 which is similar to the first spacing distance 52.

The attachment means 112 includes a chamber attachment aperture 122 formed in the chamber peripheral wall 22, at least one bracket attachment aperture 124 extending through the bracket attachment leg 118 and an attachment component such as an attachment bolt 126 and associated attachment nut 128 for extending through both the chamber attachment aperture 122 and the bracket attachment aperture 124.

Preferably, each bracket attachment leg 118 is provided with a set of spaced apart chamber attachment apertures 122 for allowing adjustment of the height 121 of the bracket supporting leg 120 and the supporting rod 70'. Also, the bracket supporting leg 120 is typically provided with at least one retaining notch 130 for restricting lateral movement of the supporting rod 70'. Preferably, the bracket supporting leg is provided with a plurality of retaining notches 130 formed therealong for allowing adjustment of the size of the spacing 114.

Although the present log combustion method and supporting device therefor has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A log supporting structure for supporting a log positioned within a combustion chamber, said log having a generally elongated configuration defining a log longitudinal axis, a log circumferential surface, a log first end and an opposed log second end, said combustion chamber defining a chamber base wall and having a gas contained therein; said log supporting structure comprising:

a generally elongated supporting rod defining a rod longitudinal axis, a rod circumferential surface, a rod first end and an opposed rod second end, said supporting rod for supporting said log first end at a predetermined location therealong so that said log longitudinal axis extends in a generally perpendicular relationship relative to said rod longitudinal axis and in an angled relationship relative to and adjacent said chamber base wall with said log first end positioned above said log second end;

a spacing base extending from said supporting rod for resting on said chamber base wall and maintaining said supporting rod in a predetermined spaced relationship relative to said chamber base wall;

said spacing base having a generally flaring configuration in a geometrical plane generally perpendicular to said rod longitudinal axis and in a direction leading away from said supporting rod;

said spacing base being provided with a longitudinal venting means for allowing said gas to flow between said chamber base wall and said supporting rod in a first flow direction generally parallel to said supporting rod at least partially along said supporting rod;

said spacing base being provided with a transversal venting means for allowing said gas flowing in said first flow direction to flow in a second flow direction generally perpendicular to and away from said supporting rod at said predetermined location along said supporting rod and generally parallel to said chamber base wall from said lop first end toward said log second end.

2. A supporting structure as recited in claim 1 wherein said longitudinal venting means allows said gas to flow in said first flow direction from a position located adjacent said rod first end to a position located intermediate said rod first and second ends.

3. A supporting structure as recited in claim 2 wherein said longitudinal venting means allows said gas to flow in said first flow direction from a position located adjacent said rod first end to a position located adjacent said rod second end.

4. A supporting structure as recited in claim 1 wherein said spacing base includes at least two spacing legs, each of said spacing legs having a generally flaring configuration in a geometrical plane generally perpendicular to said rod longitudinal axis and in a direction leading away from said supporting rod; said longitudinal venting means including a venting aperture formed in at least one of said spacing legs, said transversal venting means including said legs being spaced from each other along said supporting rod so as to define a leg spacing therebetween.

5. A supporting structure as recited in claim 4 wherein at least one of said spacing legs has a generally triangular configuration defining a leg apex and a leg base, said leg apex being attached to said supporting rod.

6. A supporting structure as recited in claim 5 wherein said venting aperture has a generally triangular configuration defining a generally triangular aperture frame, said aperture frame including a frame bridging segment extending across said leg base and a pair of frame spacing segments tapering towards each other in a direction leading from opposed ends of said frame bridging segment towards said leg apex.

7. A supporting structure as recited in claim 4 wherein at least one of said spacing legs is provided with at least one resting prong extending therefrom, said resting prong defining a prong abutment surface for abuttingly contacting said chamber base wall when said log supporting structure is resting on said chamber base wall, said resting prong defining a base wall-to-leg clearance between said chamber base wall and said spacing leg when said prong abutment surface abuttingly contacts said chamber base wall.

8. A supporting structure as recited in claim 5 wherein at least one of said spacing legs is provided with a pair of spaced apart resting prongs extending therefrom, each of said resting prongs defining a prong abutment surface for abuttingly contacting said chamber base wall when said log supporting structure is resting on said chamber base wall, said resting prongs defining a base wall-to-leg clearance between said chamber base wall and said spacing leg when said prong abutment surfaces abuttingly contacts said chamber base wall.

9. A supporting structure as recited in claim 1 wherein said rod circumferential surface defines a generally arcuate rod-to-log contacting section.

10. A supporting structure as recited in claim 9 wherein said rod-to-log contacting section extends over an angular range at least equal to 180 degrees.

11. A supporting structure as recited in claim 5 wherein said supporting rod has a generally disc-shaped cross-sectional configuration and said leg apex defines a generally arcuate rod receiving recess for receiving a rod-to-leg contacting section of said rod circumferential surface, wherein the remainder of said rod circumferential surface defines a rod-to-log contacting section having a generally arcuate configuration.

12. A supporting structure as recited in claim 11 wherein said supporting rod and said spacing leg are both made out of a metallic alloy, said rod-to-leg contacting section being attached to said rod receiving recess by welding.

13. A supporting structure as recited in claim 12 wherein said spacing leg is made out of a generally flat piece of material.

14. A method for combusting a wood log inside a combustion chamber, said combustion chamber having an air inlet, an air outlet; said wood log having a generally elongated configuration defining a log longitudinal axis, a log first end, a log second end, a log length, a log diameter and a log circumferential surface, said method comprising the steps of:

positioning said log within said combustion chamber generally adjacent said chamber base wall in a combustion configuration wherein said log first end is at a first spacing distance relative to said chamber base wall and wherein said log second end is at a second spacing distance relative to said chamber base wall, said first spacing distance being greater than said second spacing distance so that said log longitudinal axis is generally angled relative to and adjacent said chamber base wall and so that said log and said chamber base wall define a generally triangular air volume therebetween;

ensuring that said air volume between said log and said chamber base wall allows circulation of air generally thereacross in both a first direction generally perpendicular to said lop longitudinal axis adjacent said log first end and a second direction generally parallel to said chamber base wall from said log first end toward said log second end;

igniting said log; and maintaining said log in said combustion configuration during at least part of the combustion of said log.

15. A method as recited in claim 14 wherein the step of positioning said log within said combustion chamber generally adjacent said chamber base wall ensures that said rod longitudinal axis is angled from said chamber base wall by an angle of about fifteen (15) degrees.

16. A method as recited in claim 14 further comprising the step of adjusting the angular relationship between said rod longitudinal axis and said chamber base wall so as to modulate the combustion speed.

17. A method as recited In claim 16 wherein the angular relationship between said rod longitudinal axis and said chamber base wall is further adjusted so as to maintain a flame burning substantially along and across said log.

* * * * *